US012487054B2

(12) United States Patent
Zloczower et al.

(10) Patent No.: US 12,487,054 B2
(45) Date of Patent: Dec. 2, 2025

(54) BORE SIGHTING TARGET MOUNT

(71) Applicants: Leon Zloczower, Ness Ziona (IL); Ami Mesilati, Rechovot (IL)

(72) Inventors: Leon Zloczower, Ness Ziona (IL); Ami Mesilati, Rechovot (IL)

( * ) Notice: Subject to any disclaimer, the term of this patent is extended or adjusted under 35 U.S.C. 154(b) by 0 days.

(21) Appl. No.: 18/761,446

(22) Filed: Jul. 2, 2024

(65) Prior Publication Data

US 2025/0020436 A1 Jan. 16, 2025

Related U.S. Application Data

(60) Provisional application No. 63/525,723, filed on Jul. 10, 2023.

(51) Int. Cl.
*F41G 1/54* (2006.01)

(52) U.S. Cl.
CPC ..... *F41G 1/545* (2013.01)

(58) Field of Classification Search
CPC ..... F41B 1/545
USPC ..... 42/116
See application file for complete search history.

(56) References Cited

U.S. PATENT DOCUMENTS 3,782,740 A * 1/1974 Peyrot ..... B23K 37/053 279/22
4,090,305 A * 5/1978 Cassidy ..... F41G 1/54 33/391
4,767,125 A * 8/1988 Barry ..... B23B 31/404 279/2.15
5,092,071 A * 3/1992 Moore ..... F41G 1/35 42/105
5,432,598 A * 7/1995 Szatkowski ..... F41G 1/545 356/153
5,448,834 A * 9/1995 Huang ..... F41G 1/545 279/2.12
5,685,106 A * 11/1997 Shoham ..... F41G 1/35 42/116
6,397,509 B1 * 6/2002 Langner ..... F41G 1/54 42/114
6,572,375 B2 * 6/2003 Shechter ..... F41A 21/26 42/114
7,377,556 B2 * 5/2008 Ho ..... F16L 55/132 285/382.5
7,765,703 B2 * 8/2010 Buckus ..... B64F 5/10 33/645
7,900,391 B1 * 3/2011 Mihelish ..... F41A 31/02 42/134
8,484,880 B1 * 7/2013 Sellers ..... F41G 1/54 42/116
9,513,086 B2 * 12/2016 Wenn ..... F41G 1/54
10,739,109 B1 * 8/2020 Tello ..... F41G 3/08
2012/0167440 A1 * 7/2012 StPhillips ..... F41A 21/32 42/116
2024/0053124 A1 * 2/2024 Kroeger ..... F41G 1/545
2025/0020436 A1 * 1/2025 Zloczower ..... F41G 1/545

FOREIGN PATENT DOCUMENTS

WO WO2000017596 3/2000

* cited by examiner

*Primary Examiner* — Samir Abdosh

(57) ABSTRACT

A system and method for calibrating a weapon using a precision barrel mount calibration system, wherein one or more components of the precision barrel mount calibration system are self-centering, and the system is configured to prevent scratching of an inner surface of the barrel.

18 Claims, 6 Drawing Sheets

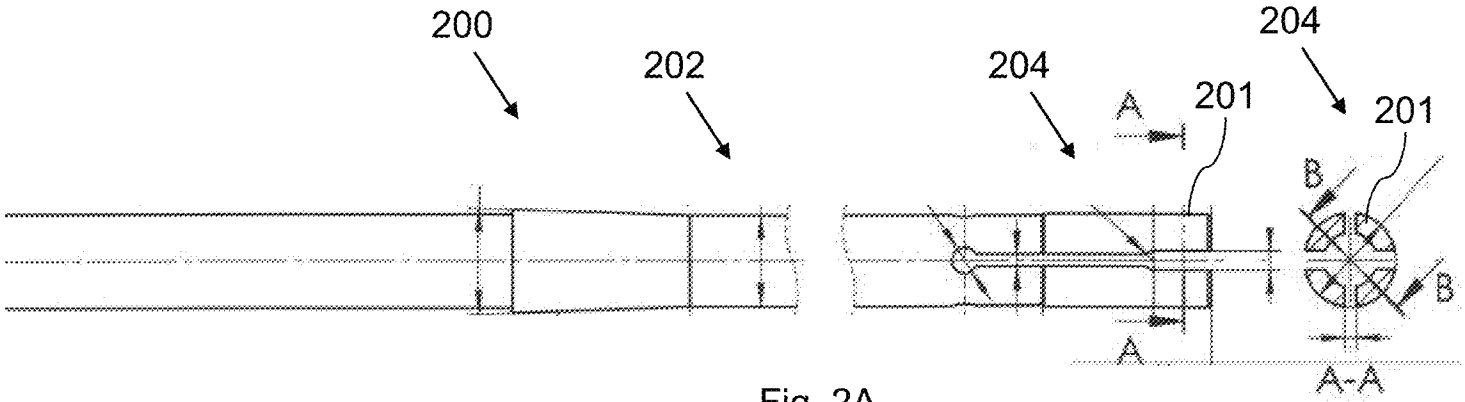
Fig. 2A
Fig. 2B
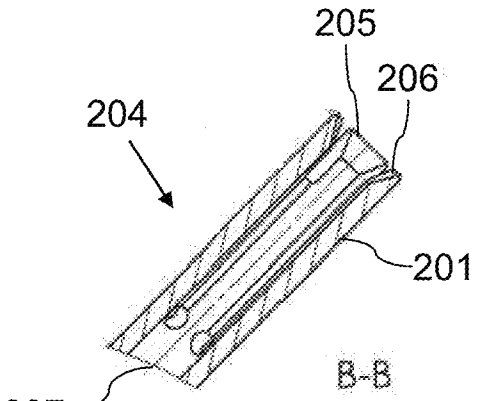
Fig. 2C

BORE SIGHTING TARGET MOUNT

RELATED APPLICATIONS

This application claims the benefit of priority under 35 USC § 119(e) of U.S. Provisional Patent Application No. 63/525,723 filed 10 Jul. 2023, the contents of which are incorporated herein by reference in their entirety.

FIELD AND BACKGROUND OF THE INVENTION

The present invention in some embodiments thereof relates to a precision bore sighting target mount and, more particularly, but not exclusively, to a boresighting target mount which may be inserted into a rifle barrel.

Calibrating the sight of a rifle, for example a military assault weapon, facilitates maintaining the effectiveness of the soldier in the field.

US Patent Application Publication no. 20120167440 appears to disclose, "A bore sight including a rear casing, a front casing sized to cooperatively engage the rear casing and define a first cavity and a separate second cavity, a laser disposed within the first cavity, and a battery in the second cavity. The bore sight further includes a switch selectively connecting the battery and the laser, an elongate mandrel releasably engaging the rear cavity, the mandrel having a free-end, a tapered seating collar having a through hole sized to receive a length of the mandrel, the seating collar being a separate components from the mandrel and the rear casing, wherein the seating collar can be formed of a different second material than the mandrel and the rear casing; and an adaptor releasably engaging a free end of the mandrel."

U.S. Pat. No. 9,513,086 appears to disclose, "A system includes a boresight insert configured to be partially inserted into a barrel of a weapon. The boresight insert includes an optics section configured to generate light that identifies an impact point for a projectile from the weapon. The boresight insert includes a mechanical section coupled to the optics section. The mechanical section is configured to engage an inner surface of the barrel to secure the boresight insert in place and to disengage the inner surface of the barrel to allow insertion and removal of the boresight insert."

U.S. Pat. No. 8,484,880 appears to disclose, "A bore sight (10) is provided that can be used with many calibers of firearms (12) to align optical devices such as rifle scopes. The bore sight (10) has a housing (22) with a spring loaded arbor (26) extending from one end thereof. The arbor (26) has a tapered face (32) varying in diameter in a range including popular calibers, such as .17 to .50 caliber. The arbor (26) is inserted in the end (20) of the barrel (18) as far as the caliber of the barrel (18) permits. The arbor (26) then starts retracting into the housing (22) against the spring force to allow the magnetic alignment face (24) of the housing to move into contact with the end (20) of the barrel to align the bore sight (10) and laser (30) with the bore (16)."

U.S. Pat. No. 7,377,556 appears to disclose, "An adapter mount for attaching to a fitting tube includes an adapter tube having an outer circumferential surface; a first expandable ring placed on the outer circumferential surface of the adapter tube and comprising of elastic material for expanding and fitting to the inner surface of the fitting tube; an adjustment ring configured to be threaded to the adapter tube to generate a rotational threading force; a compression ring for translating the rotational threading force from the adjustment ring to a longitudinal compressing displacement of the first expandable ring, causing an outer surface of the first expandable ring to fit to the inner surface of the fitting tube; and a stop attached to the adapter tube for preventing the adjustment ring from separating from the adapter tube."

U.S. Pat. No. 5,092,071 appears to disclose, "An accessory mount particularly well suited to a broad variety of weapons (e.g., Heckler & Koch firearms) comprises a plug portion that fits within the weapon accessory mounting hole and is radially expanded, e.g., by means of an interior mandrel, to provide large area, high friction, robust engagement between the plug and the mounting hole. A second portion for holding an accessory (e.g., a laser sight) is coupled to the plug by an alignment means and a hand operated screw or lock so that the accessory is easily removed and reinstalled in the same position relative to the weapon boresight without need for recalibration."

International Patent Application Publication no. WO 2000017596 appears to disclose, "A gun safety lock (12, 14, 16) is provided which makes it impossible to discharge the gun (10) accidentally because it is impossible to chamber a live round into the firearm (10) with the safety lock (12, 14, 16) installed."

U.S. Pat. No. 6,572,375 appears to disclose, "A firearm laser training system according to the present invention includes a laser transmitter assembly and a cartridge adapter assembly, while employing modified blank cartridges to simulate firearm operation. The modified blank cartridges each have a quantity of explosive substance sufficient only to cycle the firearm. The laser assembly is configured for attachment to a firearm barrel and front sight and emits a beam of laser light toward a training system target in response to actuation of the firearm trigger. The laser beam is generally in the form of a pulse having a duration sufficient for the system target to detect a beam impact location. The cartridge assembly is disposed within the firearm barrel to adapt the firearm for compatibility with the modified blank cartridges for simulating firearm operation."

Therefore, there is still a need for a precision sighting tool for sight calibration that supports a sighting target precisely centered on a weapon.

SUMMARY OF THE INVENTION

According to an aspect of some embodiments of the invention, there is provided a system connection to a barrel of a weapon including: an anchor configured to be inserted into the barrel, wherein the anchor is configured to be reversibly expanded within the barrel; a shaft connected on a distal end thereof to the anchor; an adaptor fixed to a proximal portion of the shaft; and a mount configured to be affixed to the adaptor.

According to some embodiments of the invention, the anchor includes a mandrel.

According to some embodiments of the invention, the mount is configured for attachment of a target to facilitate calibration of a weapon.

According to some embodiments of the invention, the anchor includes at least two reversibly expandable sections.

According to some embodiments of the invention, the anchor is self-centering within the barrel.

According to some embodiments of the invention, the system further includes a muzzle cone the muzzle cone fixed to the shaft between the mount and the anchor.

According to some embodiments of the invention, the muzzle cone is conical.

According to some embodiments of the invention, the muzzle cone, is configured to fit to an entrance to the barrel thereby centering the proximal portion of the system with respect to an axis the barrel.

According to some embodiments of the invention, the adaptor is tapered.

According to some embodiments of the invention, the adapter includes a protrusion from the shaft which tapers distally.

According to some embodiments of the invention, the mount includes a tapered hole configured to accept the protrusion.

According to some embodiments of the invention, the adaptor is self-centered by a taper of the tapered hole.

According to some embodiments of the invention, adapter includes multiple mounting holes at various distances from an axis of the tapered hole.

According to some embodiments of the invention, the system further includes a target mounted at a desired height distance from the barrel by inserting a mounting post of the target into one of the mounting holes.

According to an aspect of some embodiments of the invention, there is provided a method attaching a mount to a weapon including: providing a shaft having an anchor on a distal end thereof and a mount on a proximal portion thereof; inserting a distal portion of the shaft into a barrel of the weapon with the anchor in a collapsed state that is smaller than an internal diameter of the barrel; reversibly expanding the anchor radially to contact an inner wall of the barrel, thereby centering the anchor in the barrel.

According to some embodiments of the invention, the shaft further includes a muzzle cone configured to fit to an entrance to the barrel between the mount and the anchor further including: contacting the muzzle cone to the entrance of the barrel of the weapon and retaining the muzzle cone in contact with the entrance while performing the reversible expanding of the anchor.

According to some embodiments of the invention, the method further includes connecting an adaptor to the mount.

According to some embodiments of the invention, the mount includes a tapered projection and wherein the adaptor includes a tapered hole and wherein the connecting includes inserting the tapered projection into the tapered hole.

According to some embodiments of the invention, the method further includes attaching a target to the adaptor.

According to some embodiments of the invention, the method further includes calibrating the weapon using the target.

According to some embodiments of the invention, the expanding includes radially extending at least two sections of the anchor within the barrel to self-center the anchor.

According to some embodiments of the invention, the method further includes wherein the expanding locks the anchor in place within the barrel.

According to some embodiments of the invention, the muzzle cone is conical and wherein the retaining centers a proximal portion of the shaft within the barrel.

According to some embodiments of the invention, the adapter includes multiple mounting holes at different distances from an axis of the tapered hole further including: mounting the target at a desired height and/or distance from the barrel by inserting a mounting post into a selected hole of the multiple mounting holes.

DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIGS. 2A, 2B and 2C: Cross sectional views of a schematic diagram of a distal portion of a precision bore sighting target mount system, in accordance with some embodiments of the current invention.

DESCRIPTION OF SPECIFIC EMBODIMENTS OF THE INVENTION

Figure 1:
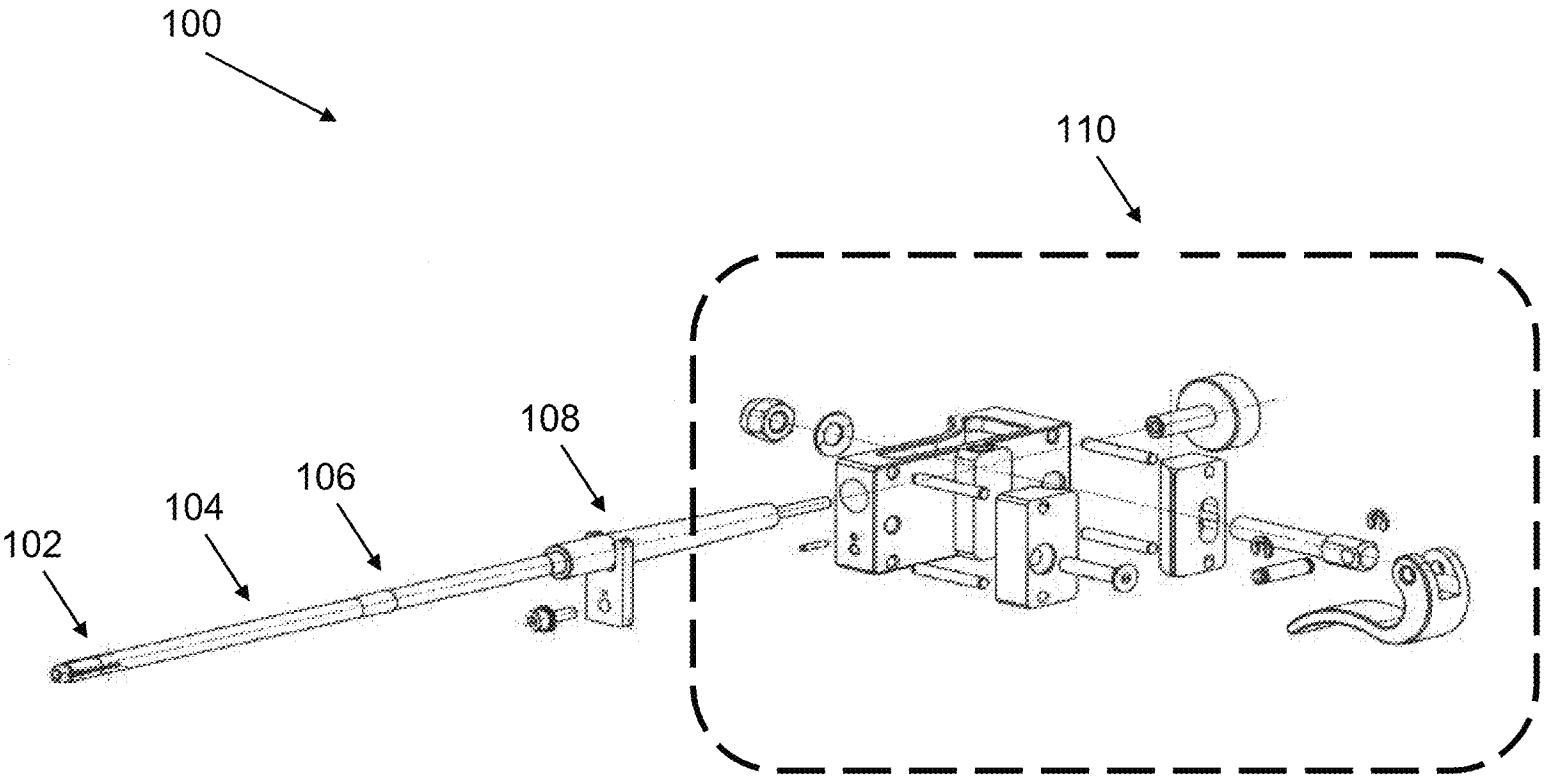
FIG. 1: Schematic view of a precision bore sighting target mount system, in accordance with some embodiments of the current invention.

The present invention in some embodiments thereof relates to a boresighting target mount and, more particularly, but not exclusively, to a boresighting target mount which may be inserted into a rifle barrel.

Overview

According to some embodiments, sight calibration may be facilitated by a precision sighting tool that supports a sighting target precisely centered on the weapon. Optionally, the sighting tool may be a barrel-mounted target mount. Optionally, the barrel-mounted target mount may center perfectly onto a variety of gun barrels, whether new or worn. Optionally, the barrel-mounted target mount be mounted on a barrel when the weapon includes a muzzle accessory. Optionally, the barrel-mounted target mount be mounted on a barrel when the weapon does not include a muzzle accessory.

According to some embodiments, a barrel-mounted target mount may be designed to avoid damage to the inside of the weapon's barrel. Optionally, a barrel-mounted target mount may be designed to avoid damage to the inside of a rifle-barrel.

According to some embodiments, the mount and/or support may be configured for ease-of-use and/or durability. For example, the mount and/or support may be durable under use by a soldier in the field under war conditions. Optionally, the mount and/or support may be suitable with different models of weapons, sights, and muzzle accessories (such as flash suppressors, muzzle brakes and compensators).

An aspect of some embodiments of the current invention relates to a device including a shaft. Optionally, the shat may be configured to be centered and/or locked into the barrel of a weapon, e.g., rifle, shotgun, gun, etc. For example, the shaft may include a rod having an outer diameter that is less than the inner diameter of the weapon. Optionally, the shaft may be configured to lock into the barrel of a rifle and/or to hold a mount for a target for calibrating a sight of the rifle. Optionally, the shaft may hold a target for calibrating a sight. Optionally, the shaft may include an expanding centering anchor on its distal end and/or a muzzle cone (e.g., a protuberance tapered distally) on a proximal portion. Herein, the distal direction of the mounting system is defined towards the end of the shaft that inserts into the barrel towards the breach of the gun. Herein the proximal direction of the mounting system is defined towards the end of the mounting system that protrudes from the muzzle of the gun. Note that this is opposite distal and proximal as sometimes used with respect to a rifle itself (e.g., distal with respect to the rifle is towards the muzzle of the barrel and proximal as towards the stock).

In some embodiments, features may facilitate positioning of the device precisely. Optionally, the device may be positioned centrally on a new and/or worn barrel. Optionally, the shaft may avoid scratching the barrel when the device is inserted. Optionally, the shaft may be narrower than the barrel, e.g., in order to avoid scratching an inner surface of the barrel. Optionally, the shaft may include a mandrel. Optionally, some or all portions of the mandrel (e.g., the anchor) which may be inserted into the barrel may be composed of a material that is softer than the gun barrel, for example, brass, aluminum, plastic, etc.

According to some embodiments, a sighting target may be mounted on an external section of the shaft. For example, the mounting section may extend proximal to a tapered section out of the barrel of the rifle. Optionally, there may be a mount on the shaft for various targets. Optionally, the mount may be equipped with tapered holes at different heights from the weapon barrel.

According to some embodiments, a distal portion of the shaft may include a reversibly expandable anchor. Optionally, the distal expander may be expanded to precisely center the distal portion and/or anchor the shaft in place. Optionally, the anchor may be inserted into the barrel of the weapon. Optionally, the anchor may not scratch the inside of the barrel as it is inserted into the barrel. Optionally, the anchor may be expandable. Optionally, the anchor may be reversibly expanded within the barrel of the weapon. Optionally, the anchor may be retracted to a non-expanded state on insertion and/or extraction of the shaft into the barrel.

According to some embodiments, an expandable anchor on a distal portion of the mandrel may be inserted into the barrel in a radially retracted state. This may facilitate fitting into the barrel without scratching the sides thereof. For example, the mandrel including the anchor may not touch the inner walls of the barrel during insertion.

Alternatively, or additionally, the mandrel and/or the anchor may touch the inner wall of the barrel, with minimal force (e.g., less than 0.1 N, and/or between 0.1 to 1 N, and/or between 1 to 10 N, and/or between 10 to 100 N). Optionally, once the mandrel is in place the anchor may be expanded radially to contact and/or press against an inner wall of the barrel. Optionally, the anchor may be maintained stationary, e.g., since the anchor remains stationary, it should not scratch the barrel. Optionally, before removing the mandrel, the anchor may be radially retracted, so that it may not scratch an inner wall of the barrel upon removal.

According to some embodiments, the device may include an anchor. Optionally, the expandable anchor may center to a distal portion of the barrel. Optionally, the expandable anchor may be hollow.

According to some embodiments, the expandable anchor may reversibly expand a distal portion thereof. Optionally, the expandable anchor may reversibly expand a distal portion thereof symmetrically and/or asymmetrically. Optionally, the expandable anchor may include two or more sections. Optionally, the sections may be expanded outwards. Optionally, the sections may be expanded outwards symmetrically and/or asymmetrically. Optionally, in an expanded state one or more sections may contact an inner surface of the barrel.

According to some embodiments, the anchor may be configured to expend radially equally (symmetrically), thus self-centering within the barrel. For example, anchor may expand equally in opposing radial directions for example in 4 directions, and/or 3 directions, and/or between 2 to 15 directions, and/or between 5 to 9 directions.

Optionally, the expandable anchor may expand at an angle from a central line bisecting the anchor longitudinally. Optionally, the angle may range between 0.1° to 2° and/or between 2° to 5° about 5° to about 15°, and/or between about 15° to about 30°, and/or between about 30° to about 45°, and/or between about 45° to about 60°.

According to some embodiments, the expandable anchor in a non-expanded state may have an external diameter ranging between about 2 mm to about 5 mm, and/or between about 5 mm to about 10 mm, and/or between about 10 mm to about 14 mm.

According to some embodiments, the expandable anchor in an expanded state may have an external diameter ranging between about 2.2 mm to about 5.5 mm, and/or between about 5.5 mm to about 10.1 mm, and/or between about 10.1 mm to about 15 mm.

In some embodiments, an anchor may be designed for a barrel having an inner diameter of 5.56 mm and/or 7.62 mm and/or 6.5 mm and/or 10.9 mm and/or 11.6 mm. In the collapsed state, the anchor, optionally, has an outer diameter significantly smaller than the inner diameter of the barrel for which is it designed, for example, this may inhibit scratching the inside of the barrel as the anchor is inserted. For example, the outer diameter of the anchor in a collapsed state may be smaller than the inner diameter of the barrel of the gun for which it is designed by less than 0.1% and/or between 0.1 to 0.5% and/or between 0.5 to 2% and/or between 2 to 5% and/or between 5 to 20%. Optionally, the outer diameter of the rod of the mounting system may be smaller than the inner diameter of the barrel of the gun for which it is designed by less than 1% and/or between 1 to 2% and/or between 2 to 5% and/or between 5 to 20%.

According to some embodiments, a muzzle cone may be connected to the expandable anchor by a shaft assembly. Optionally, the shaft assembly may be extendable. Optionally, the shaft assembly may have a length ranging between about 5 cm to about 10 cm, and/or between about 10 cm to about 20 cm, and/or between about 20 cm to about 40 cm.

According to some embodiments, the shaft holding the device to the barrel of the gun may include a muzzle cone on a proximal portion. Optionally, the muzzle cone may include a tapered section. Optionally, the muzzle cone may be conical. Optionally, the widest portion of the muzzle cone may have a diameter larger than the inner diameter of the barrel. Optionally, the muzzle cone may fit exactly to the entrance to the muzzle of the barrel e.g., centering the proximal portion. Optionally, the narrowest portion of the muzzle cone may fit within the barrel. Optionally, the portion of the muzzle cone within the barrel may not contact an inner surface of the barrel.

According to some embodiments, the muzzle cone may center the proximal portion at the mouth/muzzle of the weapon. According to some embodiments, the muzzle cone may be connected to an adaptor, and/or mount, and/or support.

According to some embodiments, a target may be mounted on an external section of the shaft (extending proximal to the tapered section out of the barrel of the rifle). Optionally, there may be a mount on the shaft for various targets. Optionally, the mount may be equipped with tapered holes at various heights and/or distances from the barrel. Optionally, a target may be mounted at a desired height and/or distance by inserting a mounting post into one of the holes. Optionally, the mounting post may be self-centered by the taper of the hole.

According to some embodiments, a system described herein in accordance with the current invention may advantageously include one or more the following characteristics:

It may facilitate precise centering of the shaft.

It may avoid damaging the barrel.

It may be convenient, with a high degree of ease-of-use.

It may be highly durable.

It may be compatible with various models of weapons, sights, and accessories.

It may be used on a new or worn barrel.

Specific Embodiments

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Reference is now made to the figures.

FIG. 1 is a schematic view of a precision bore sighting target mount system, in accordance with some embodiments of the current invention. For example, system 100 includes a rod 104 for insertion into a barrel of a weapon. The system 100 optionally includes an expandable anchor 102 on a distal portion of the rod 104. Optionally, a muzzle cone 106. In some embodiments, muzzle cone 106 is, connected (optionally via an adaptor 108), to a mount 110 (e.g., for a bore sight).

FIGS. 2A, 2B and 2C are cross sectional views of a schematic diagram of a rod or shaft 202 of a precision bore sighting target mount system, in accordance with some embodiments of the current invention. In some embodiments, a distal portion of the shaft 202 includes a reversibly expandable anchor 204. Optionally, a distal portion of the shaft 202 includes a muzzle cone 200.

In some embodiments, the anchor 204 includes an expanding mandrel. For example, completely or partially surrounding the distal end of the shaft 202 are expandable sleeve segments 201, which move radially outward to grip the internal surface barrel of the gun. A plug 205, fits into the mandrel body between the sleeve segments 201. Optionally, the internal sides 206 of the distal ends of the sleeve segments 201 are tapered inward. Alternatively or additionally, the plug 205 is ball shaped and/or tapered and/or conical in shape. The plug 205 is optionally configured to move axially. This movement is facilitated, for example by the drawbar 207 and/or pull rod. For example, the drawbar 207 may include a threaded rod running through the center of the mandrel body.

In some embodiments, expansion of the mandrel works by moving the drawbar 207 (e.g., by twisting a nut on a proximal portion of the shaft 202) to pull or push the plug proximally into the mandrel body. This axial movement forces the expandable sleeve segments 201 outward, pressing them against the internal surface of the rifle barrel for a secure and precise grip. Conversely, the contraction mechanism involves moving the drawbar 207 in the opposite direction to retract the plug distally out from between the sleeve segments 201, releasing the tension on the expandable sleeve segments 201 and allowing them to move back inward.

In some embodiments, the expanding mandrels may use a simple mechanical movement like tightening a drawbar to expand the segments. Alternatively or additionally a hydraulic mechanism may use hydraulic pressure for a more uniformly and powerfully expand the mandrel. Alternatively or additionally, a cam system and/or lever may be used to expand the mandrel.

In some embodiments, expandable anchor 204 may include two or more sections. Optionally, the sections may expand outwards. Optionally, the sections may be configured to expend radially equally (symmetrically), thus self-centering within the barrel. For example, anchor may expand equally in opposing radial directions for example in 4 directions, and/or 3 directions, and/or between 2 to 15 directions, and/or between 5 to 9 directions.

Expandable anchor 204 is connected through shaft 202 to a muzzle cone 200. Optionally, muzzle cone 200 may be and/or may include a tapered portion. Optionally, muzzle cone 200, or a portion thereof, may fit exactly to the entrance to the barrel e.g., centering the proximal portion. Optionally, the portion of the muzzle cone within the barrel may not contact an inner surface of the barrel.

Figures 3A, 3B, 3C:
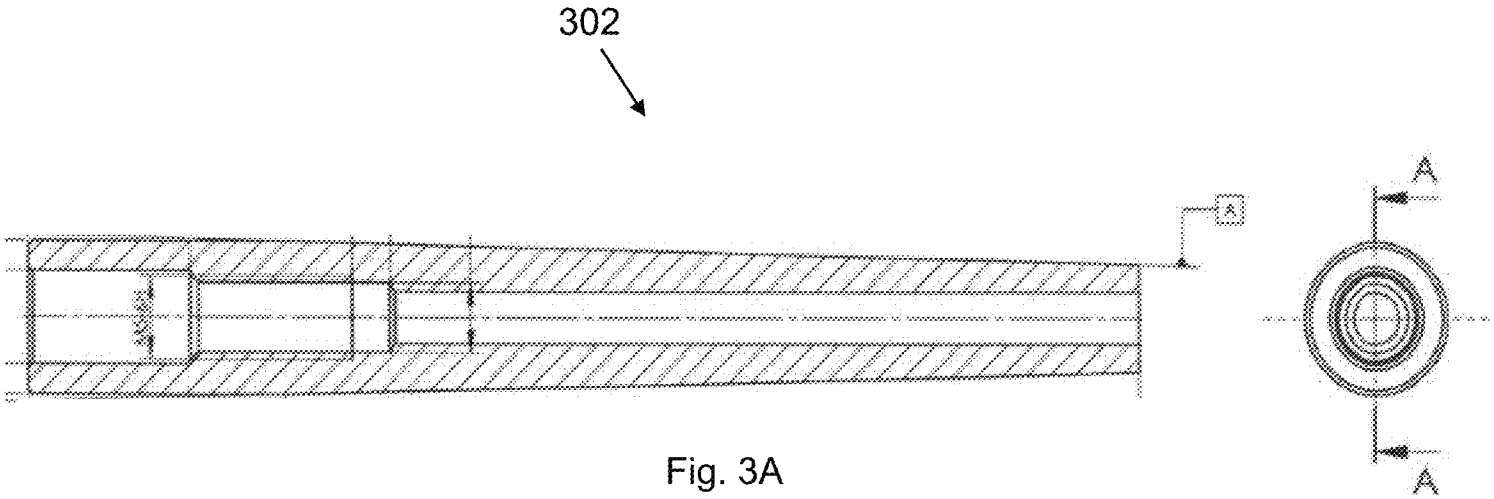
FIGS. 3A, 3B and 3C: Cross sectional views of a schematic diagram of an intermediate portion of a precision bore sighting target mount system, in accordance with some embodiments of the current invention.

FIGS. 3A, 3B and 3C are cross sectional views of a schematic diagram of an adaptor 302 of a precision bore sighting target mount system, in accordance with some embodiments of the current invention. For example, adaptor 302 may be connected to a shaft assembly (not shown). Optionally, the shaft assembly and/or the adaptor may be extendable. Optionally, adaptor 302 may be tapered. Adaptor 302 may connect to a mount (not shown) for various targets. Optionally, the mount may be equipped with tapered holes at various heights and/or distances from the barrel. Optionally, adaptor 302 may be inserted into a tapered hole of the mount. Optionally, adaptor 302 may be self-centered by the taper of the hole. Optionally, adaptor 302 may be fixed in position. Optionally, a target may be mounted at a desired height and/or distance by inserting a mounting post into one of holes on the mount.

Figure 4A:
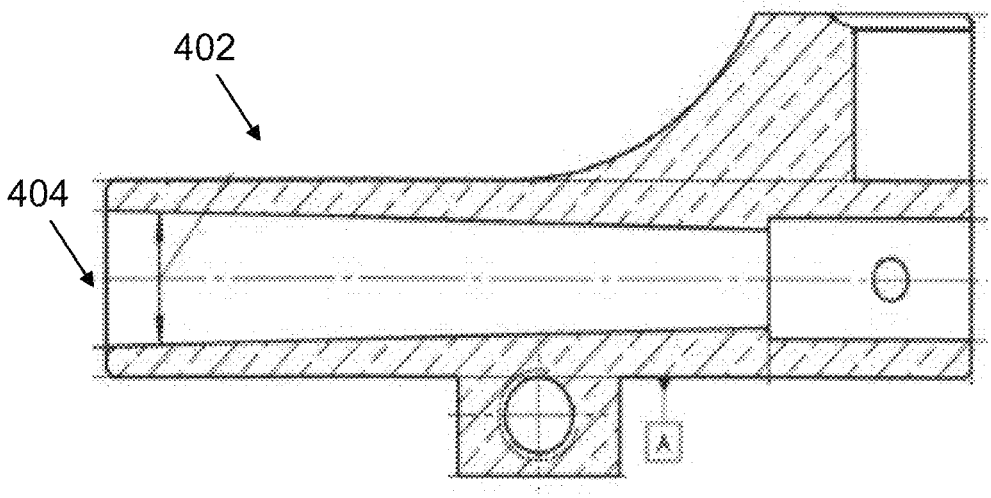
FIGS. 4A and 4B: Cross sectional view and perspective view, respectively, of a schematic diagram of a distal portion of precision bore sighting target mount system, in accordance with some embodiments of the current invention.
Figure 4B:
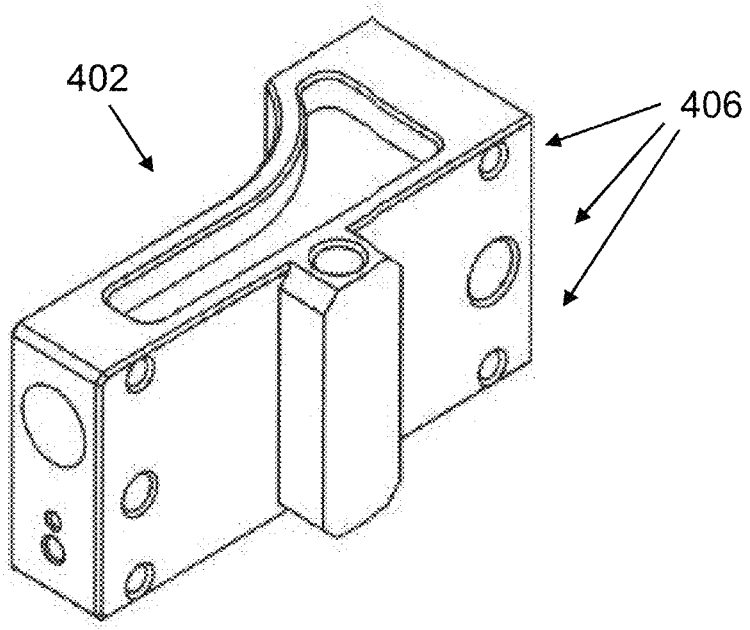

FIGS. 4A and 4B are cross sectional view and perspective view, respectively, of a schematic diagram of a distal portion of precision bore sighting target mount system, in accordance with some embodiments of the current invention. For example, mount 402 is located on a distal portion of precision bore sighting target mount system. Mount 402 includes a tapered hole 404. A tapered adaptor (not shown) may be inserted into tapered hole 404. Optionally, the adaptor may be self-centered by the taper of tapered hole 404. Optionally, a target may be mounted at a desired height and/or distance by inserting a mounting post into one of the holes 406 on mount 402. Optionally, mount 402 may include holes at various heights and/or distances from the barrel.

Figure 5:
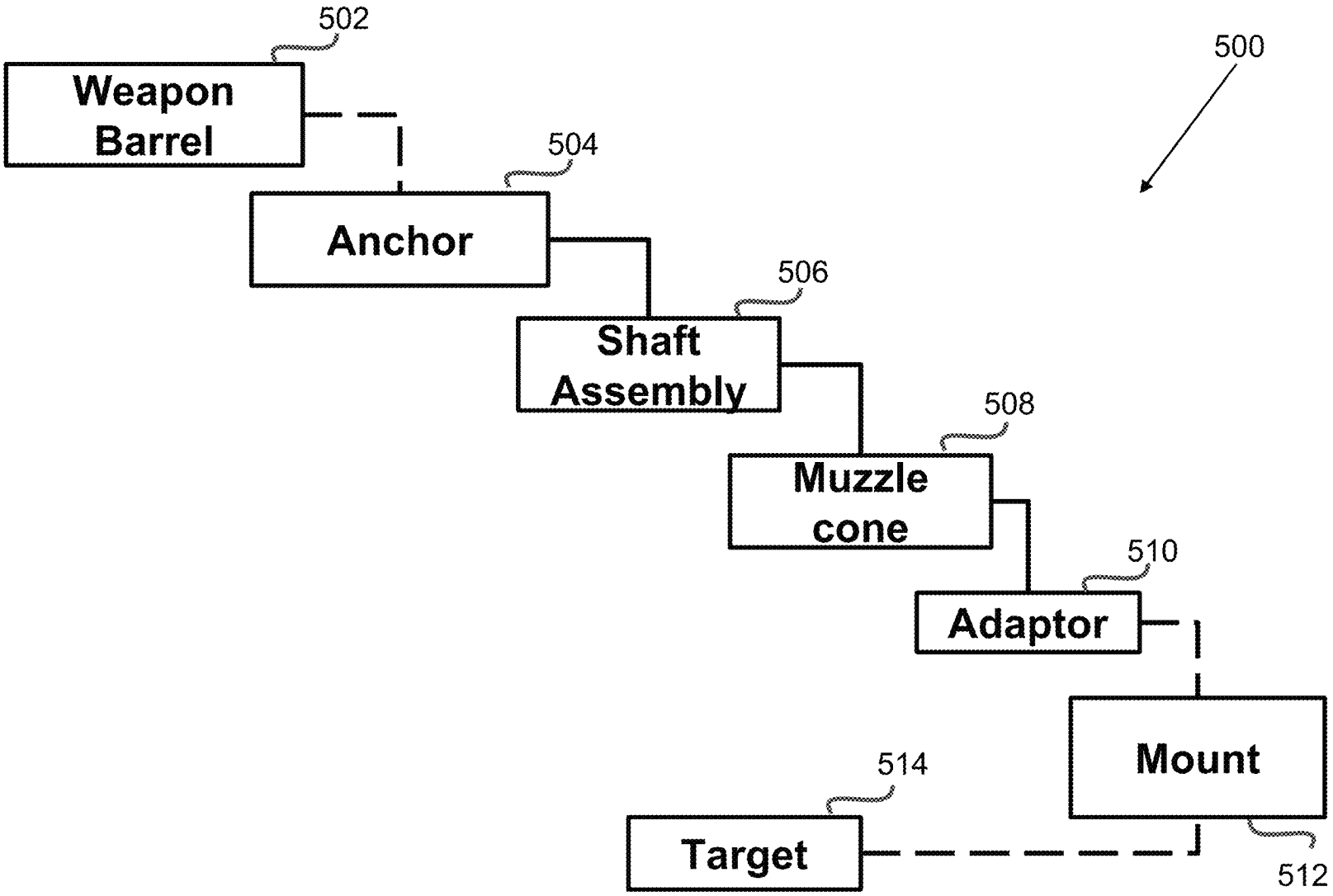
FIG. 5: Block diagram of a precision bore sighting target mount system, in accordance with some embodiments of the current invention.

FIG. 5 is a block diagram of a precision bore sighting target mount system, in accordance with some embodiments of the current invention. For example, in system 500, mandrel anchor 504 may be inserted into a weapon barrel 502. Anchor 504 may be expanded for precise centering. Anchor 504 may be affixed to shaft assembly 506. Shaft assembly 506 may be connected to adaptor 510 via muzzle cone 508, which may be affixed to mount 512. A target 514 may be attached to mount 512 to calibrate the weapon.

Figure 6A:
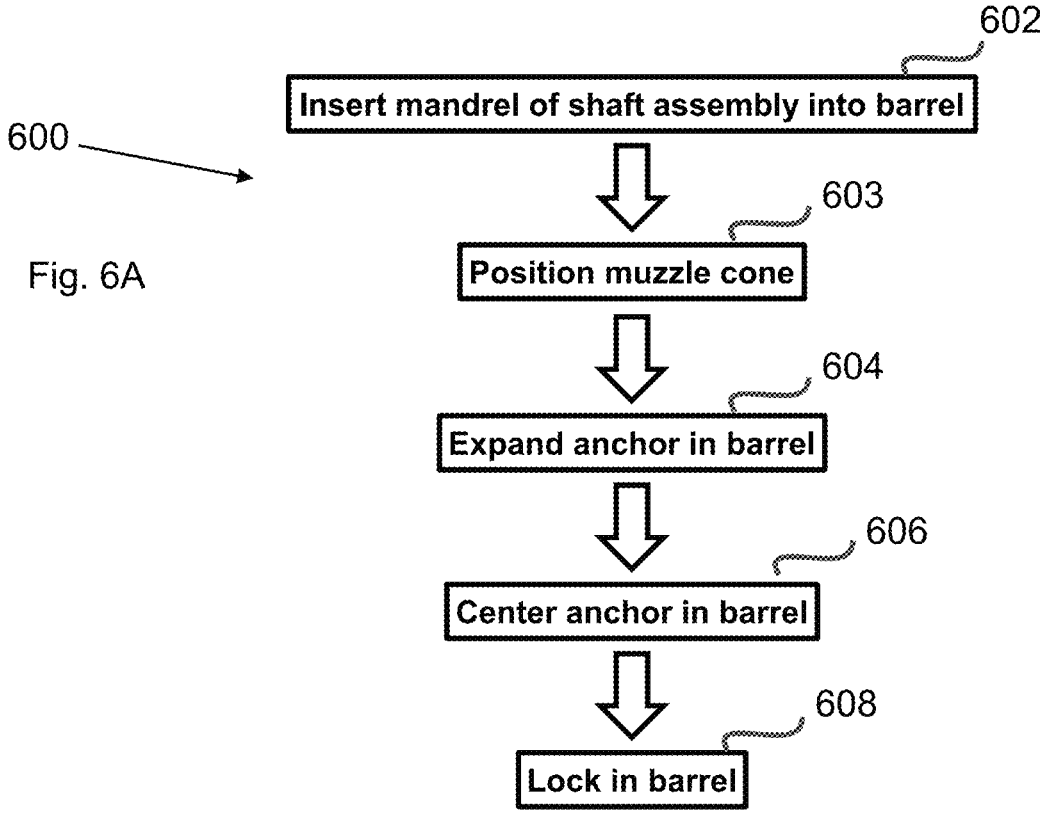
FIGS. 6A and 6B: Flow charts of methods of use of a precision bore sighting target mount system, in accordance with some embodiments of the current invention.

FIG. 6A is a flow chart of a method of positions of a precision bore sighting target mount system to a gun barrel, in accordance with some embodiments of the current invention. For example, in method 600, a mandrel anchor is inserted 602 into a weapon barrel. For example, the mandrel anchor is inserted 602 in a collapsed state. Optionally, the mandrel in the distal end of a shaft is inserted 602 until a muzzle cone on a proximal portion of the shaft reaches the mouth of the barrel and/or is positioned 603 in and/or wedged into the distal opening of the barrel. The mandrel anchor is optionally expanded 604 radially to contact and/or press against the inner walls of the barrel to center 606 the anchor in the barrel. Optionally, the anchor may lock 608 the shaft of the mounting assembly in the barrel.

Figure 6B:
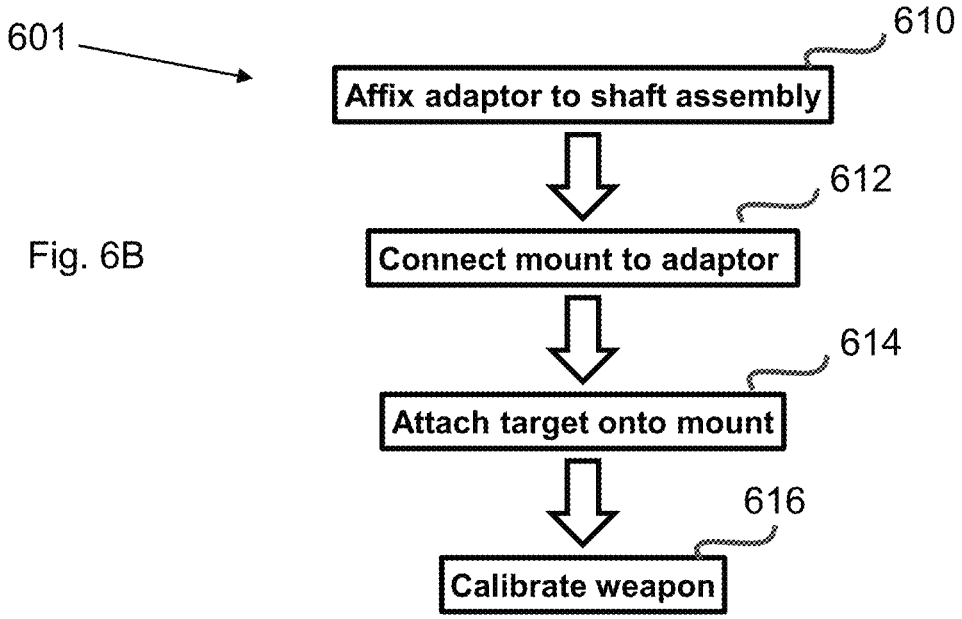

FIG. 6B is a flow chart of a method attaching a bore sighting target mount system to a gun barrel attachment system, in accordance with some embodiments of the current invention. For example, in the method 601, an adaptor may be affixed 610 to the shaft assembly. The mount may be connected 612 to the adaptor. A target may be attached 614 on the mount. The weapon may be calibrated 616 using the precisely centered target.

It is expected that during the life of a patent maturing from this application many relevant technologies will be developed and the scope of the terms are intended to include all such new technologies a priori.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Measurements described herein may be approximate. Embodiments of the invention may have measurements that are for example, ±5% those described and/or ±20% those described and/or ±50% those described and/or ±200% those described.

As used herein the term "about" refers to ±10%

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A system for connection to a barrel of a weapon comprising:

an anchor configured to be inserted into the barrel, wherein the anchor is configured to be reversibly expanded within the barrel;

a shaft connected on a distal end thereof to said anchor;

an adaptor fixed to a proximal portion of the shaft; and a mount configured to be affixed to the adaptor, wherein the adaptor includes a protrusion from the shaft which tapers distally and the mount includes a tapered hole configured to accept the protrusion.

2. The system of claim 1, wherein the anchor comprises at least two reversibly expandable sections.

3. The system of claim 1, wherein the anchor is self-centering within the barrel.

4. The system of claim 1, further comprising a muzzle cone said muzzle cone fixed to said shaft between said mount and said anchor.

5. The system of claim 4, wherein the muzzle cone is conical.

6. The system of claim 5, wherein the muzzle cone, is configured to fit to an entrance to the barrel thereby centering said proximal portion of the system with respect to an axis the barrel.

7. The system of claim 1, wherein the mount is configured for attachment of a target to facilitate calibration of a weapon.

8. The system of claim 1, wherein the adapter includes multiple mounting holes at various distances from an axis of the tapered hole.

9. The system of claim 8, further comprising a target mounted at a desired height distance from the barrel by inserting a mounting post of the target into one of said mounting holes.

10. The method of claim 8, wherein the shaft further includes a muzzle cone configured to fit to an entrance to the barrel between the mount and the anchor further comprising: contacting said muzzle cone to the entrance of the barrel of the weapon to center a proximal portion of the shaft in relation to the barrel and retaining said muzzle cone in contact with said entrance while performing said reversibly expanding of the anchor.

11. A method attaching a sighting tool to a weapon comprising:

providing a shaft having an anchor on a distal end thereof and a mount on a proximal portion thereof;

inserting a distal portion of the shaft into a barrel of the weapon with the anchor in a collapsed state that is smaller than an internal diameter of the barrel;

reversibly expanding the anchor radially to contact an inner wall of the barrel, thereby centering the anchor in the barrel; and connecting an adaptor to the mount, wherein said mount includes a tapered projection and wherein said adaptor includes a tapered hole and wherein said connecting includes inserting said tapered projection into said tapered hole.

12. The method of claim 11, further comprising attaching a target to the adaptor.

13. The method of claim 12, wherein the expanding comprises radially extending at least two sections of the anchor within the barrel to self-center the anchor.

14. The method of claim 11, wherein said expanding locks the anchor in place within the barrel.

15. A method attaching a sighting tool to a weapon comprising:

providing a shaft having an anchor on a distal end thereof and a mount on a proximal portion thereof;

inserting a distal portion of the shaft into a barrel of the weapon the anchor in a collapsed state that is smaller than an internal diameter of the barrel;

reversibly expanding the anchor radially to contact an inner wall of the barrel, thereby centering the anchor in the barrel;

connecting an adaptor to mount; and attaching a target to the adapter, wherein the adapter includes multiple mounting holes at different distances from an axis of the barrel of the weapon further comprising: mounting the target at a desired height and/or distance from the axis of the barrel of the weapon by inserting a mounting post into a selected hole of the multiple mounting holes.

16. The method of claim 15, wherein the shaft further includes a muzzle cone configured to fit to an entrance to the barrel between the mount and the anchor further comprising: contacting said muzzle cone to the entrance of the barrel of the weapon to center a proximal portion of the shaft in relation to the barrel and retaining said muzzle cone in contact with said entrance while performing said reversibly expanding of the anchor.

17. The method of claim 15, wherein the expanding comprises radially extending at least two sections of the anchor within the barrel to self-center the anchor.

18. The method of claim 15, wherein said expanding locks the anchor in place within the barrel.

* * * * *